US006443850B1

(12) United States Patent
Choi

(10) Patent No.: US 6,443,850 B1
(45) Date of Patent: Sep. 3, 2002

(54) SWING 2000 GOLF SWING TRAINING DEVICE

(76) Inventor: Richard Wonsik Choi, 9000 Belanca Ave., Los Angeles, CA (US) 90045

( * ) Notice: Subject to any disclaimer, the term of this patent is extended or adjusted under 35 U.S.C. 154(b) by 0 days.

(21) Appl. No.: 09/495,718

(22) Filed: Feb. 1, 2000

(51) Int. Cl.[7] ..... A63B 53/06; A63B 53/16; A63B 69/36; A63B 53/02

(52) U.S. Cl. ..... 473/224; 473/257; 473/312

(58) Field of Search ..... 473/257, 258, 473/259, 260, 269, 312, 334, 224, 234; D21/733, 734, 735, 737, 742

(56) References Cited

U.S. PATENT DOCUMENTS

| | | | | | |
|---|---|---|---|---|---|
| 1,492,039 | A | * | 4/1924 | Leven | 473/233 |
| 2,002,108 | A | * | 5/1935 | Child | 473/239 |
| 2,501,277 | A | * | 3/1950 | Hollopeter | 473/233 |
| 3,113,781 | A | * | 12/1963 | Guier | 473/234 |
| 3,136,546 | A | * | 6/1964 | Connolly | 473/234 |
| 4,283,057 | A | * | 8/1981 | Ragan | 473/234 |
| 4,819,941 | A | * | 4/1989 | Tanaka | 293/186 |
| 4,878,672 | A | * | 11/1989 | Lukasiewicz | 473/234 |
| 5,271,622 | A | * | 12/1993 | Rogerson | 473/234 |
| 5,895,328 | A | * | 4/1999 | Pahio | 473/224 |

OTHER PUBLICATIONS

Merriam–Webster's Collegiate Dictionary (www.m–w.com).*

* cited by examiner

*Primary Examiner*—Paul T. Sewell
*Assistant Examiner*—Alvin A. Hunter, Jr.
(74) *Attorney, Agent, or Firm*—John E. Vanderburgh; Stites & Harbison

(57) ABSTRACT

A golf swing training device comprising a golf club having a head, shaft and grip and a piston assembly housing is disposed in the club head. A piston is disposed in the housing and is movable therein in a direction parallel to the shaft of the club. A spring loaded detent acts against the piston to retain it in an upper position in the housing. Air vents in the top and sole of the club head communicate with the interior of the housing to maintain atmospheric pressure within the housing and to prevent any resistance against the piston which would be caused by compressing air in the housing. As the club is swung the speed of the club head generates centrifugal force that, if sufficient, overcomes the retaining force of the detent and allows the piston to move downward in that housing toward the sole of the club. When the piston strikes a floor of the housing an audible click can be heard. An adjuster knob has a threaded shaft that acts against the spring to compress it against the detent ball urging the detent ball into the annular groove of the piston to secure the piston in the up position. The force required to release the piston is adjusted by turning the adjuster knob to increase or decrease the compression on the spring which increases or decreases the force of the detent ball against the piston.

2 Claims, 3 Drawing Sheets

SWING 2000 GOLF SWING TRAINING DEVICE

FIELD OF THE INVENTION

The invention relates to a swing training devices for golf clubs and more particularly to a training golf club which is adjustable for the swing speed and strength of the user.

BACKGROUND OF THE INVENTION

The prior art is replete with swing training devices which are designed to aid a golfer in the development of a proper swaying. For example, weight attachments for golf clubs have been designed to adjust the center gravity or the weight of the golf club during practice to improve coordination and timing. Such devices are exemplified by U.S. Pat. No. 5,776,006, issued Jul. 7, 1998 to Isaac Gruber and U.S. Pat. No. 4,969,921, issued Nov. 13, 1990 to Richard Silvera.

Gruber discloses an attachment for golf clubs consisting of two weighted elements which are clamped together around the shaft of a golf club. The device can be clamped any point along the shaft to add weight nearer the club head or the grip to vary the center of gravity of the club.

Silvera discloses a device comprising a tube which is clamped on the shaft of a golf club and which contains a spring loaded weight. As the club is swung, centrifugal force urges the weight axially in the tube toward the club head and the user feels increased torque during the swing.

Another device designed to indicate if the user is generating sufficient club head speed is described in U.S. Pat. No. 5,868,634, issued Feb. 9, 1999 to Choi et al. This device comprises a piston located in a housing at the club head. A spring urges the piston upwardly and swinging clubs at proper speed develops centrifugal force which causes a piston to act against the spring and to be displaced toward the club head. When the piston is sufficiently displaced an audible click can be heard and, additionally, an electrical circuit is activated to light a bulb to provide a visual indication of the proper club head speed.

The prior art devices, although effective for some users, are not effective universally because many users generate different club head speed. The swing force necessary to obtain the proper indication or feel from these devices is preset by the force of the springs in the device or by the weight of the device. Thus, some golfers may not generate the force and speed required to activate the devices while others generate too much club head speed and force for the device. In the same fashion, it is difficult to adjust the weights in the purely weighted devices. Thus, users who are both and below average in strength and swing speed derive little or no benefit from these training devices. In fact such devices may actually be detrimental to the proper swing tempo and swing speed of such individuals by causing them either to over swing or underswing in order to receive an indication of proper swing speed from the training device.

Accordingly, it would be highly desirable to provide a swing training device which can be adjusted to compensate for the strength and swing speed of the the user. In this manner the user could use the training device to develop the proper tempo for their personal swing speed and strength and avoid under swinging or overswinging.

SUMMARY OF THE INVENTION

It is an object of the present invention to provide a swing training golf club to aid golfers in the development of the proper swing speed in accordance with the individual's physical characteristics.

Another object of the invention is to provide a golf swing trainer which has the feel of a regular club and that emits an audible signal when the proper centrifugal force is generated by the user.

Yet another object of the invention is to provide a golf swing trainer that can be adjusted for the strength of the user.

These and other objects and advantages of the invention are achieved by a golf swing training device comprising a golf club having a head, shaft and grip. The club head is adapted for training by the provision of a piston assembly in the club head. A piston is disposed in the housing of the piston assembly and is movable therein in a direction parallel to the shaft of the club. A spring loaded detent acts against the piston to retain it in an upper position in the piston assembly. Air vents in the top and sole of the club head communicate with the piston assembly to maintain atmospheric pressure within the piston assembly and to prevent any resistance against the piston which would be caused by compressing air in the piston assembly.

As the club is swung the speed of the club head generates centrifugal force that, if sufficient, overcomes the retaining force of the detent and allows the piston to move downward in that piston assembly housing toward the sole of the club. When the piston strikes a floor of the piston assembly an audible click can be heard. The click should be heard as the club head travels through the hitting zone, that is the lower part of the swing arc, indicating that the user has developed the proper swing speed and tempo. Improper swing tempo will result no sound being heard or in the click being heard while the club is descending before the hitting zone or after the club passes through the hitting zone during fall through.

These and other features and advantages of the present invention will be readily apparent from the following detailed description of the invention taken in conjunction with the accompanying drawings, wherein he like reference characters represent like elements.

DESCRIPTION OF THE PREFERRED EMBODIMENTS

Figure 1:
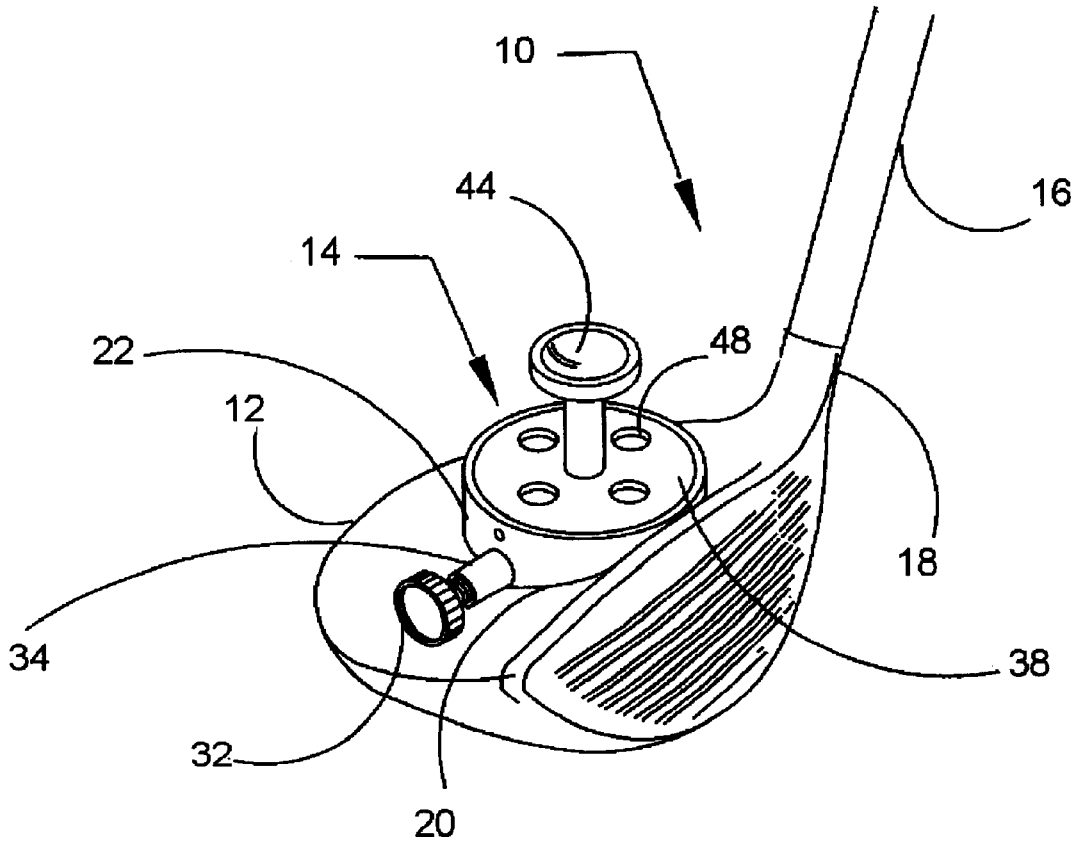
FIG. 1 is a perspective view of the head portion of the swing training golf club of the present invention.

Referring to FIG. 1, the swing training golf club of the present invention, shown generally as 10, comprises a club head 12, a piston assembly 14 and a shaft 16 that terminates in a grip portion (not shown) as is conventional. The shaft 16 and club head 12 are joined at the hosel 18. As illustrated, a seat 20 is formed in the club head 12 and the piston assembly 14 is received therein. The club head 12 illustrated is a club head such as found on the so-called "woods" which normally consist of the driver and the fairway clubs. It will be understood, however, that the head of the training device of the invention may also be fashioned as a blade type head such is would be found on the "irons", that is normally the 2–9 iron, the sand wedge and pitching wedge. The design of the wood head is preferred as it lends itself most conveniently for receiving the piston assembly 14 and allows for weight adjustment so that the device has the feel of a regular golf club when it is swung.

Figure 2:
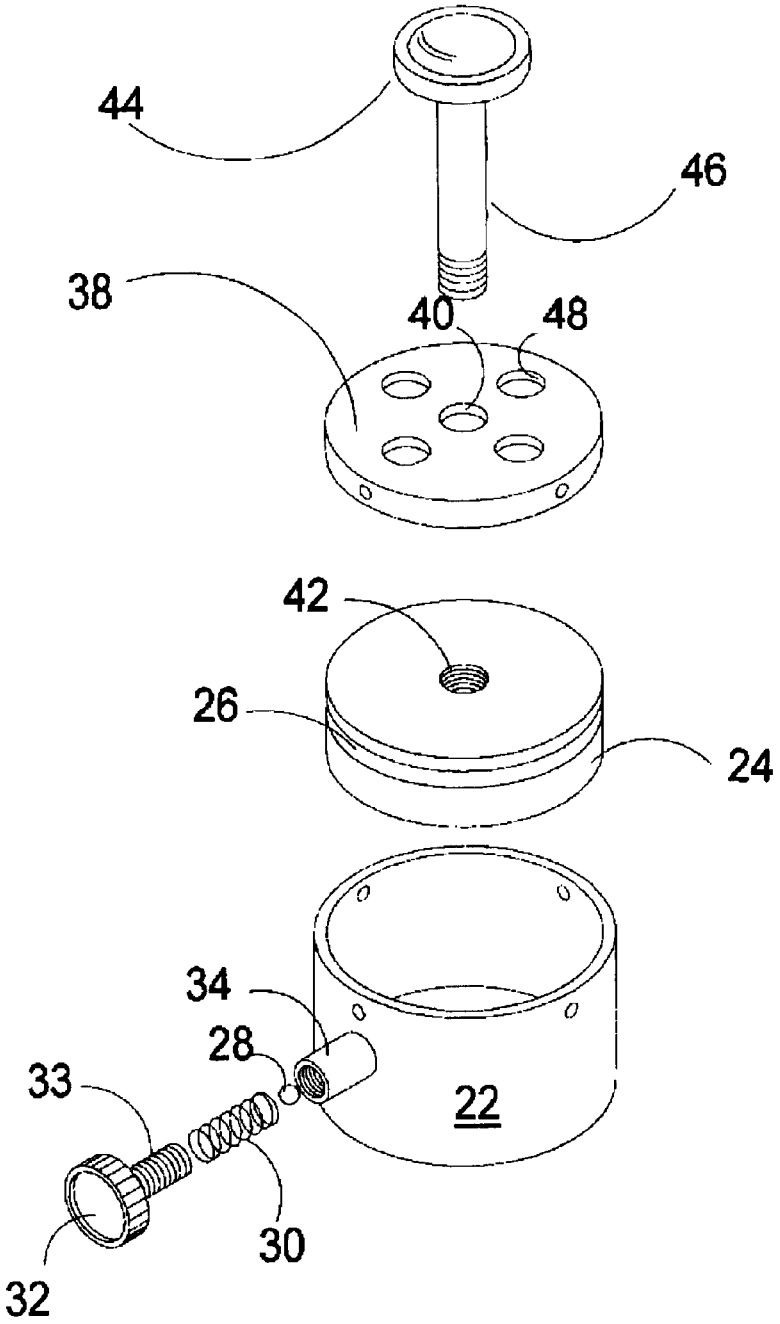
FIG. 2 is an exploded view of the piston assembly of the device of the present invention.

Referring to FIG. 2, the piston assembly 14 comprises a housing 22 which is received in the seat 20 formed in the club head 12 or that is secured to the club head, such as would be the case of an iron club. A piston 24 is disposed in the housing 22 for movement therein. The piston 24 moves in the housing 22 in a direction essentially parallel to the shaft of the club. An annular groove 26 is disposed about the upper portion of the piston 24. A spring loaded detent consisting of a detent ball 28, a spring 30 and an adjuster knob 32, is carried in a threaded tubular section 34 which communicates with the interior of the housing 22 through an opening 36 in the housing wall. A portion of the detent ball 28 extends through the opening 36 (FIGS. 3 and 4) into the annular groove 26 of the piston 24 when the piston is in the full up position. The opening 36 is smaller than the circumference of the detent ball 28 so that only a portion of the detent ball extends into the annular groove 26 and the detent ball is retained in the tubular section. The adjuster knob 32 has a threaded shaft that acts against the spring 30 to compress it against the detent ball 28 urging the detent ball into the annular groove 26 of the piston 24 to secure the piston in the up position. Turning the adjuster knob 32 increases the compression on the spring 30 which increases the force of the detent ball 28 against the piston. Turning the adjuster knob 32 out reduces the force. The housing 22 is closed by a disc shaped closure 38 having a central aperture 40 for alignment with a threaded socket 42 in the top of the piston 24. A piston reset knob 44 has a stem 46 that is threadably engaged in the socket 42 and extends through the aperture 40 in the closure. Several vent openings 48 are provided in the closure 38 for communication between the atmosphere and the interior of the housing 22. Likewise, as more clearly seen in FIGS. 3 and 4, a vent passage 50 in the sole of the club head 12 also communicates between the atmosphere and the interior of the housing 22. The purpose of the vent openings 48 and the vent passage 50 is to maintain atmospheric pressure within the piston assembly 14 and to avoid interference with the movement of the piston 24 in the housing 22 which would occur due to the cushioning effect of air compressed by the movement of the piston if there were no vents to the exterior of the club head.

Figure 3:
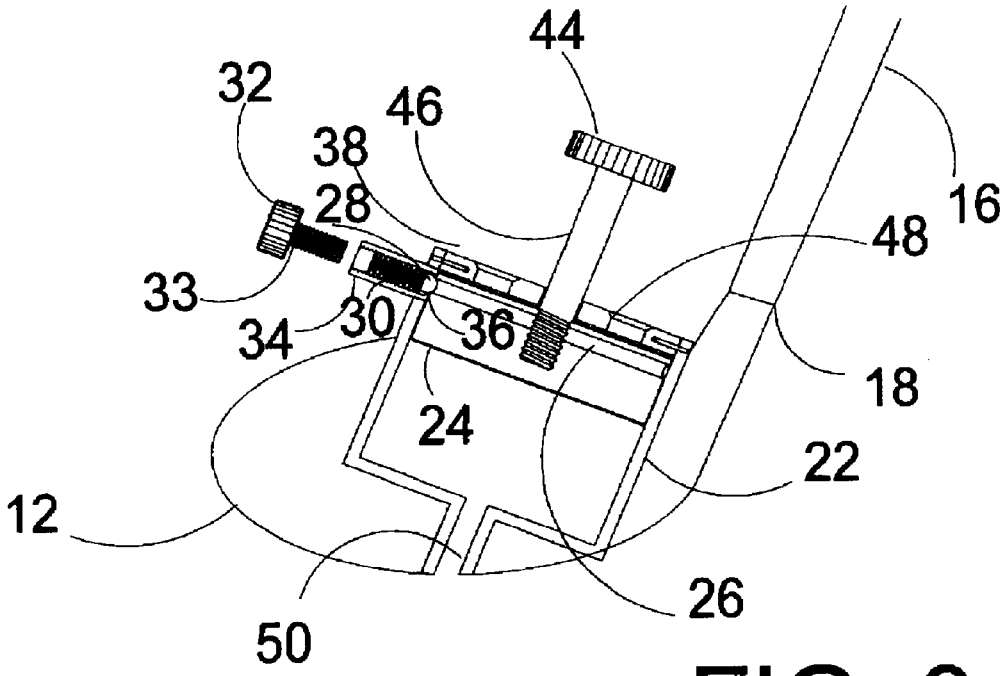
FIG. 3 is a side sectional view of the head portion of the swing training golf club showing the piston in the up position.
Figure 4:
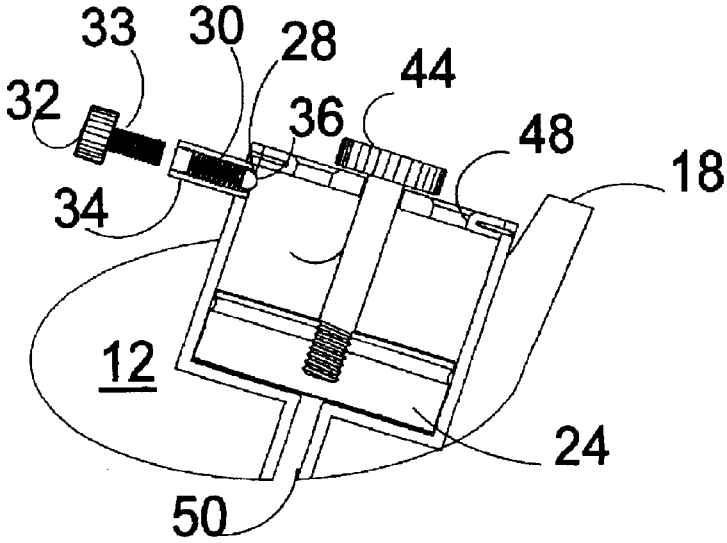
FIG. 4 is a side sectional view of the head portion of FIG. 3 showing the piston in the down of position.

As shown in FIG. 3, the piston 24 is in the full up position which is it's starting position prior to swinging the club. The detent ball 28 is forced by the spring 30 into the annular groove 26 of the piston 24 to normally secure the piston in the up position. The detent ball 28 retains the piston 24 in the up position until sufficient centrifugal force is generated by swinging the club to overcome the force of the spring 30 and detent ball allowing the piston to move downwardly to the floor of a housing 22 as illustrated in FIG. 4. The force of the piston 24 striking the floor of the housing 22 produces an audible click indicating to the user that sufficient club head speed has been generated to overcome the force of the detent. Air in the housing 22 interior is expelled from the vent in the sole of the club head. The piston 24 is returned to the up position manually by the piston return knob and the spring loaded detent ball 28 is urged back into the annular groove 26 of the piston.

It will be understood that the further the adjuster knob 32 is turned down, the more compression is placed on the spring 30 resulting in a greater centrifugal force being required in order for the piston 24 to overcome the retaining force of the spring loaded detent. Accordingly, the further the adjuster knob 32 is turned down the more swing speed will be required to generate the centrifugal force necessary to cause the piston 24 to release from the detent and move to the bottom of the housing. Each user can find the proper adjustment for his or her swing speed by gradually turning the adjuster knob 32 before each practice swing until the force applied by the detent is greater than the centrifugal forces generated by the user. The adjuster knob 32 can then be backed off a few turns and the adjustment should be proper. As the user improves his or her swing tempo and increases his or her swing speed, the adjuster knob 32 can be turned down to increase the resistance of the detent.

As will be understood by those skilled in the art, various arrangements which lie within the spirit and scope of the invention other than those described in detail in the specification will occur to those persons skilled in the art. It is therefor to be understood that the invention is to be limited only by the claims appended hereto.

Having described the invention I claim:

1. A golf swing training device comprising a golf club having a golf club head, a shaft having a lower end connected to said golf club head and an upper end defining a grip portion for grasping by a user, said golf club head carrying a piston assembly including a piston movable between an up position and a down position, an adjustable detent mechanism for applying retaining force to bold said piston in the up position until centrifugal force generated by swinging said training device overcomes the detent retaining force freeing said piston to moved to the down position whereby said detent retaining force can be increased or decreased by the user, said piston assembly including a housing said piston assembly having a closure defining an upper wall of said housing, said piston being movably contained in said housing, said piston assembly being vented to the atmosphere.

2. The golf swing training device of claim 1 wherein said closure of said housing is provided with openings for communication between the interior of said housing and the atmosphere.

* * * * *

UNITED STATES PATENT AND TRADEMARK OFFICE

CERTIFICATE OF CORRECTION

PATENT NO. : 6,443,850 B1
DATED : September 3, 2002
INVENTOR(S) : Richard Wonsik Choi It is certified that error appears in the above-identified patent and that said Letters Patent is hereby corrected as shown below:

Column 4,
Line 38, the word "bold" should read -- hold --.

Signed and Sealed this

Fifteenth Day of October, 2002

*Attest:*

*Attesting Officer*

JAMES E. ROGAN
*Director of the United States Patent and Trademark Office*